US006212283B1

(12) United States Patent
Fletcher et al.

(10) Patent No.: US 6,212,283 B1
(45) Date of Patent: Apr. 3, 2001

(54) ARTICULATION ASSEMBLY FOR INTRACANAL HEARING DEVICES

(75) Inventors: Henry Fletcher, Cameron Park; Richard C. Urso, Redwood City; Jorgen Sorensen, Tracy; Adnan Shennib, Fremont, all of CA (US)

(73) Assignee: Decibel Instruments, Inc., Fremont, CA (US)

( * ) Notice: Subject to any disclaimer, the term of this patent is extended or adjusted under 35 U.S.C. 154(b) by 0 days.

(21) Appl. No.: 08/922,928

(22) Filed: Sep. 3, 1997

(51) Int. Cl.[7] ..... H04R 25/00

(52) U.S. Cl. ..... 381/313; 381/328; 381/329; 381/324

(58) Field of Search ..... 381/313, 315, 381/322, 323, 328, 329, 324

(56) References Cited

U.S. PATENT DOCUMENTS

| | | | | |
|---|---|---|---|---|
| Re. 26,258 | | 8/1967 | Martin | 179/107 |
| 3,061,689 | | 10/1962 | McCarrell | 179/107 |
| 3,404,685 | | 10/1968 | Geib et al. | 179/107 |
| 3,527,901 | | 9/1970 | Geib | 179/107 |
| 5,390,254 | | 2/1995 | Adelman | 381/68 |
| 5,701,348 | * | 12/1997 | Shennib et al. | 381/313 |
| 5,784,471 | * | 7/1998 | Bebenroth | 381/315 |

OTHER PUBLICATIONS

Shennib et al., Patent Application Entitled "Articulated Hearing Device", U.S. Serial No. 08/365,913, filed Dec. 29, 1994.

Shennib et al., Patent Application Entitled "Acoustic Coupler" U.S. Serial No. 08/902,401, filed Jul. 29, 1997.

Gudmundsen, "Fitting CIC Hearing Aids—Some Practical Pointers," The Hearing Journal, vol. 47, No. 7, Jul. 1994.

Oliveira, et al., "A Look at Ear Canal Changes with Jaw Motion," Ear and Hearing, vol. 13, No. 6, 1992.

* cited by examiner

*Primary Examiner*—Curtis A. Kuntz
*Assistant Examiner*—Dionne N. Harvey
(74) *Attorney, Agent, or Firm*—Michael A. Glenn; Christopher Peil

(57) ABSTRACT

The invention provides a ball joint assembly for articulated hearing devices. The ball joint assembly acoustically and mechanically separates a receiver module, placed deeply within the ear canal near the tympanic membrane, from a main module, placed relatively distal to the tympanic membrane. The ball joint assembly allows for independent and free movement of the receiver module with respect to the main module. The ball joint assembly has a central axial conduit for conducting electrical wiring from the main module to the receiver module. The ball joint assembly has built in features to limit its range of motion to prevent damage to the wiring conducted within the ball joint assembly. The ball joint assembly and range limiting features are essentially fully contained within the wall of the main housing, thus minimizing the size of the hearing device and allowing for a deep and comfortable placement within the ear canal.

66 Claims, 14 Drawing Sheets

ARTICULATION ASSEMBLY FOR INTRACANAL HEARING DEVICES

BACKGROUND OF THE INVENTION

1. Technical Field

The invention relates to audio and hearing devices. More particularly, the invention relates to hearing devices that are deeply inserted into the ear canal of an individual.

2. Description of the Prior Art

Inserting an articulated hearing device deeply into the ear canal of an individual is desirable for several reasons including cosmetic appeal and improved sound fidelity. However, due to the formidable design challenges presented by deep canal placement, including comfort of fit, ease of insertion and removal and unreliability of the flexible connection, flexible or articulated hearing devices are virtually unknown in the marketplace.

Anatomy and Morphology of the Ear Canal

FIGS. 1 and 2 show a cross-sectional anatomical view of the ear canal in the coronal and transverse planes of the head, respectively. The ear canal, for the purpose of this invention, can be described as having three segments. The first segment represents the medial concha cavity 20 just behind the tragus 21, which is relatively large and is surrounded by cartilaginous tissue 22. The second cavity 23, medial to the aperture 24 of the external acoustic meatus 11, is generally smaller and is also surrounded by cartilaginous tissue 22. The third cavity 25 defines the final canal segment near the tympanic membrane 26 and is surrounded by dense bony tissue 27. The tissue 28 lining the cartilaginous region 23 is relatively thick and has a well developed subcutaneous layer thus allowing some expansion to occur. In contrast, the tissue 29 lining the bony region 25 is relatively thin and therefore, little or no tolerance for expansion exists in this region. The cartilaginous region 23 is the major area of cerumen (earwax) production and accumulation in the ear canal.

The shape of a typical external ear canal, unlike that shown in most artistic renderings is rarely cylindrical or conical with a gradual narrowing towards the tympanic membrane. Instead, most ear canals are non-uniform with various levels of tortuous contours. Some canals have severe restrictions in the cartilaginous area. The ear canal is generally "S" shaped with a first bend 30 occurring approximately at the aperture of the ear canal and a second bend 31 at the cartilaginous-bony junction. The cross sectional diameter of the ear canal and the orientation of various regions within the canal are known to vary considerably from one individual to another. For example, the length from the aperture 24 to the lateral edge 32 of tympanic membrane 26 ranges from about 20 mm to about 25 mm. The cross-sectional shape is generally oval. The smallest diameter is generally in the bony region 25 in the transverse plane and ranges from about 4 mm to about 7 mm. The largest diameter is in the medial concha region 20 in the coronal plane and ranges from about 10 mm to about 18 mm.

The morphology of the ear canal reveals substantial deformation within the cartilaginous area 23 of the canal as a result of mandibular motion associated with talking, chewing, yawning, and biting. This deformation is generally caused by the asymmetric stresses from the actions of the mandibular condyle 33 on neighboring cartilaginous tissue. These deformations have radial components, e.g. constrictions, and axial components, i.e. inward and outward motion. These radial and axial deformations can generally be felt when one inserts a finger in the ear canal and moves the jaw. In one study, using magnetic resonance imaging (MRI), the deformation was shown to be as much as 25% in the anterior-posterior direction of the cartilaginous region of the canal (see, for example Oliveira, R. J., Hammer, B., Stillman, A., Holm, J., Jons, C., Margolis, R. H., *A Look at Ear Canal Changes with Jaw Motion*, Ear and Hearing, Vol. 13, No. 6, 1992, pp. 464–466.)

The unique and tortuous nature of individual canals in combination with the dynamic canal deformations due to mandibular motion, present unsolved challenges to users of current hearing aids and other electroacoustic devices requiring deep insertion into the ear canal.

The Challenges of Deep Insertion of Hearing Devices into the Ear Canal

Inserting a receiver (speaker) deeply into the ear canal is desirable for hearing devices such as hearing aids or any earpiece for audio and communication applications. Close proximity of the receiver to the tympanic membrane improves the fidelity and efficiency of sound production. Deeper insertion also improves the external cosmetic appearance of the wearable device as it becomes less conspicuous.

In hearing aid design, articulating a receiver module within the ear canal is highly desirable in order to improve wearing comfort as well as maintain an acoustic seal at the receiver area of the hearing device. In conventional non-articulating hearing aid designs, the device must be "tightly" and precisely fitted in the ear canal in order to prevent sound leakage from the receiver (speaker) outlet of the device into the microphone inlet. These leakages cause acoustic feedback which is manifested by an annoying "whistling" sound. This "air-conducted" feedback is a common problem with many hearing aid users. Similarly, in earpieces for use with certain audio and communication devices, adequate sealing deep within the ear canal is required in order to provide fidelity and efficiency of sound production.

Because of the variability of shapes and sizes of ear canals as discussed above, and because a tight acoustic seal is required in order to prevent acoustic feedback, most hearing devices currently being marketed involve custom fabrication to ensure an "exact fit" of the earpiece to the canal of the individual. This custom process requires an impression of the ear canal, typically made by a dispensing professional. Subsequently a custom device or earmold is fabricated by the manufacturer according to the impression provided by the dispenser. The insertion and removal of the impression material within the deep portion of the ear canal is not only uncomfortable but potential complications due to hematoma or bleeding may occur (Gudmunsen, Gail, *Fitting CIC Hearing Aids-Some Practical Pointers*. The Hearing Journal, Vol. 47 , No. 7, pp. 46–47).

Unfortunately, even with custom earpieces or canal devices, canal deformations due to jaw movements lead to air gaps which are likely to cause feedback. For this reason, it is common for hearing aid users to remove the hearing device prior to eating in order to avoid the embarrassment of feedback during chewing or biting.

Another problem with the conventional hearing aid design is the "shell conduction" feedback caused by the common "shell" containing the receiver and the microphone of the device. This common housing facilitates the conduction of receiver vibrations to the microphone.

The State of the Art

Geib, et al. in U.S. Pat. Nos. 3,414,685 (see FIG. 5.) and 3,527,901 (see FIG. 8) describe a hearing device with a receiver member connected to a main compartment via a flexible link. McCarrel et al. in U.S. Pat. No. 3,061,689 disclose a hearing aid with a receiver connected to hearing aid via a "coupling member being formed of resilient and flexible material" (see FIG. 1). Martin et al. in U.S. RE 26,258 (see FIG. 3) disclose a miniaturized hearing aid "providing pivotal connection between the receiver member and the housing," and "The elongated receiver member is mounted inside of the hollow resilient boot."

The above inventions provide a resilient connection in order to provide flexibility in the orientation of the receiver within the ear canal. However, a resilient connection by nature is unduly limited in its range of motion and has a considerable bias for a centering position. Furthermore, the electrical wiring contained within the flexible joint is likely to experience damage with use due to the stress of flexing. The above inventions do not teach a rigid yet articulated joint for fit and comfort while providing protection to the interconnecting electrical wiring moving within.

Adelman in U.S. Pat. No. 5,390,254 (see FIG. 1) discloses a hearing aid with a ball joint articulation; "inner portion articulately joined to the outer portion to enable the inner portion to be positioned past the sigmoid (S-shaped) portion of the external auditory canal (see Abstract)". The ball joint assembly is hollow "acting as a conduit for the electrical conductors that lead to the speaker coils (column 12, line 45)". The ball joint scheme of U.S. Pat. No. 5,390,254 provides an improvement in the reliability of the flexible connection. However, U.S. Pat. No. 5,390,254 does not teach means for limiting the range of motion in order to prevent damage to the interconnecting electrical wiring as the ball rotates continuously in a particular direction. Another deficiency of U.S. Pat. No. 5,390,254 is that the ball joint assembly substantially intrudes into the hearing device as shown in FIG. 1. This considerable intrusion consumes valuable space within the ear canal, particularly for miniature canal devices that need to be deeply placed within the ear canal.

Shennib et al., in U.S. patent application Ser. No. 08/365,913 disclose a hearing device with one or more articulated joints as shown in FIGS. 3 and 23. A ball joint articulation is shown in FIGS. 12–14, 20, 24–26. The articulated joint of Shennib et al. allows for free movement of the receiver module and also acts as a conduit for electrical conductors to the receiver as shown in the figures. However, as with U.S. Pat. No. 5,390,254, the disclosed invention does not teach a space efficient ball joint design, nor does it teach a means to limit rotational movement for protection of electrical wires within.

For these reasons, it is desirable to provide a hearing device with a receiver module articulately separate from a main module containing a microphone. These modules are articulately separate in order to maximize mechanical and acoustical isolation between the two modules. The articulation assembly must be highly compact and durable with rigid structures, yet free to move during insertion and removal or while within the ear canal to accommodate ear canal deformations.

SUMMARY OF THE INVENTION

This invention provides a ball joint assembly for articulated hearing devices that is highly space efficient and reliable. The ball joint assembly acoustically and mechanically separates a receiver module, placed deeply within the ear canal near the tympanic membrane, from a main module, placed relatively distal to the tympanic membrane. The ball joint assembly allows for independent and free movement of the receiver module with respect to the main module. The ball joint assembly has a central axial conduit for conducting electrical wiring from the main module to the receiver module. The ball joint assembly has built in rotational stops to limit its rotational movement such that continuous rotation is prevented. These rotational stops prevent damage to the wiring conducted within the ball joint assembly.

In the preferred embodiment of the invention, rotational stops are provided by a pair of pins on a spherical ball positioned oppositely along the major axis of an elliptical socket. The minor axis of the socket contains a pair of spherical races to accommodate the spherical ball and to provide a smooth and nearly friction-free movement. The ball and the socket are made of relatively rigid material such as metal or hard plastic, thus providing an extremely durable articulation assembly.

The ball joint assembly of the preferred embodiment is relatively fully-contained within the wall of the main housing, thus minimizing the size of the hearing device. This also allows for deep and comfortable placement within the ear canal. Size reduction and deep insertion allow for a more inconspicuous placement of the hearing device, a major advantage in any hearing device design.

A flexible boot covering the articulated ball joint assembly protects the ball joint from cerumen and other debris and provides a bias force for orienting the receiver module and facilitating the insertion of the device into the ear canal. However, this bias force is minimal thus allowing the articulated modules to move relatively freely with respect to each other within the ear canal.

DETAILED DESCRIPTION OF THE INVENTION

The invention described herein is used for coupling acoustic signals in the ear canal of an individual. The articulated assembly of the present invention is adapted for use with any hearing device or any audio system for the coupling of sound deeply and comfortably into the ear canal. The invention is particularly applicable for use in conjunction with the Articulated Hearing Device described by Shennib, et al. in U.S. patent application Ser. No. 08/365,913 filed on Dec. 29, 1994, and with the Acoustic Coupler described by Shennib, et al in U.S. patent application Ser. No. 08/902,401 filed on Jul. 29, 1997.

The separation and articulation of hearing aid modules, particularly of a receiver module with respect to other modules of a hearing device, is desirable for many reasons including acoustic feedback control, greater ease of insertion deep into the ear canal, comfort while within the ear canal, and reduction of device size. Articulation is also desirable in order to allow parts of the hearing device to move independently in situ (within the ear canal) in response to canal deformation during various jaw movements. The present invention provides a highly compact and durable articulation for use with any intracanal hearing device or earpiece.

Figure 1:
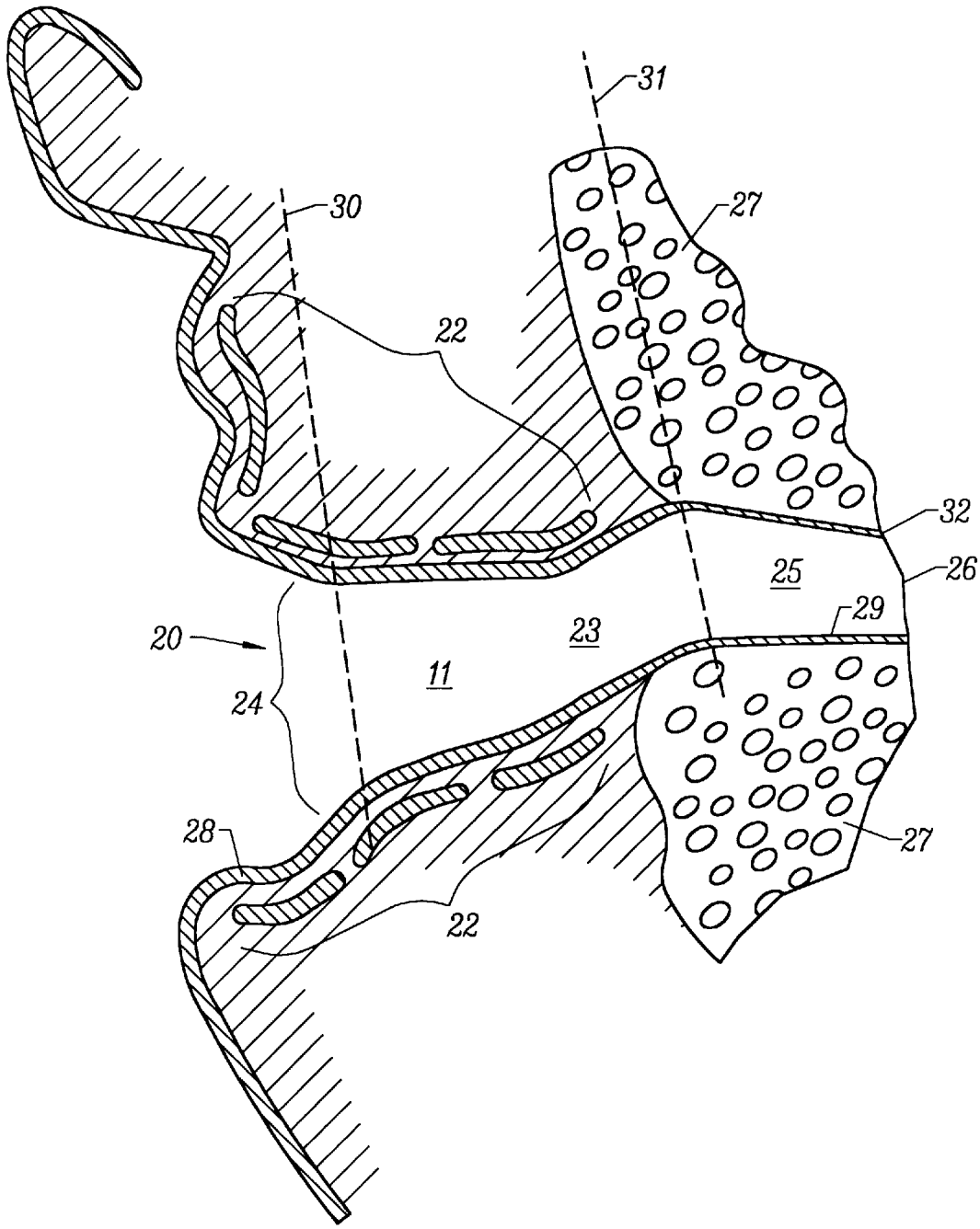
FIG. 1 is an anatomical view of an ear canal in the coronal plane.
Figure 2:
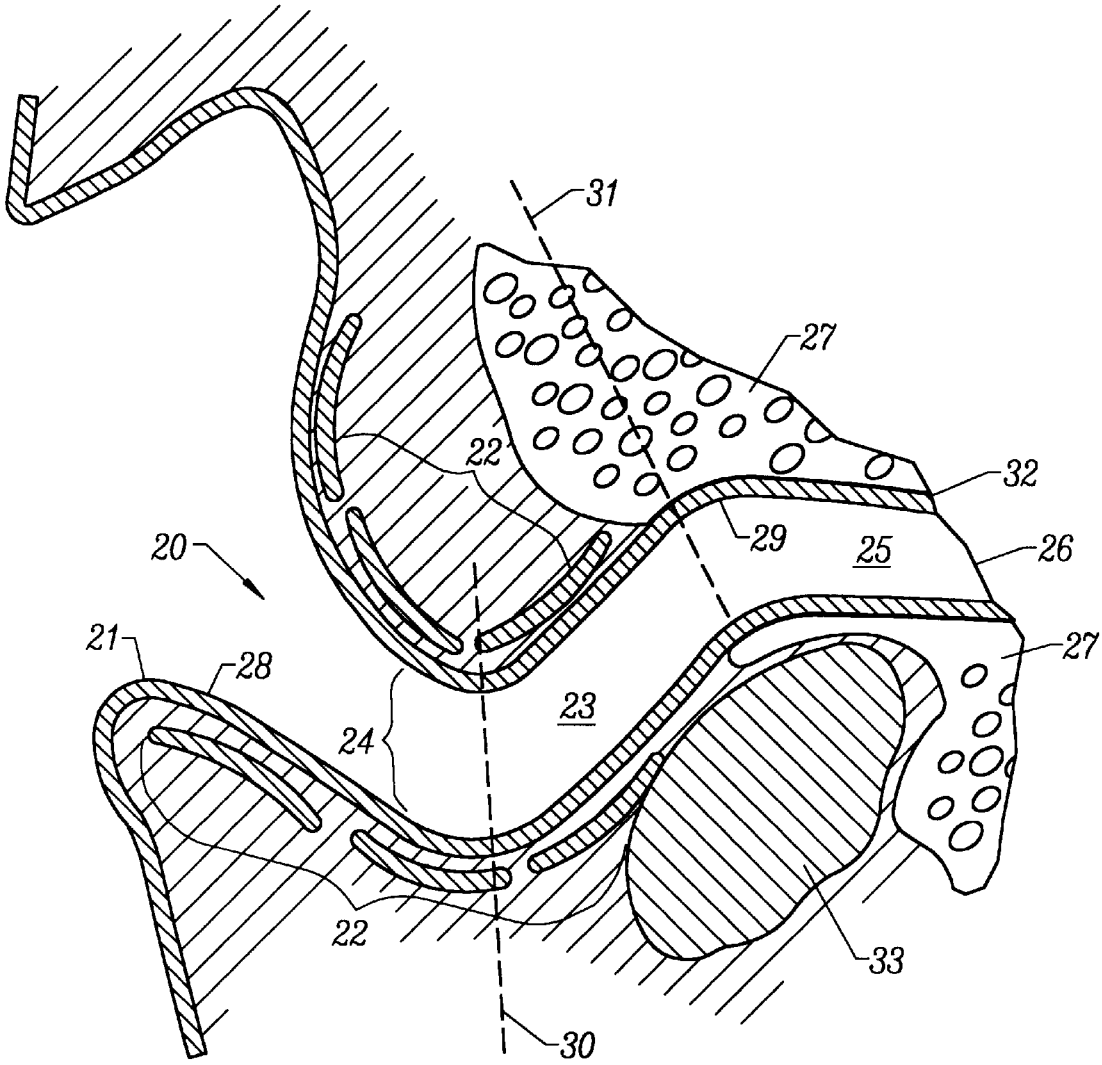
FIG. 2 is an anatomical view of an ear in the transverse plane.
Figure 3:
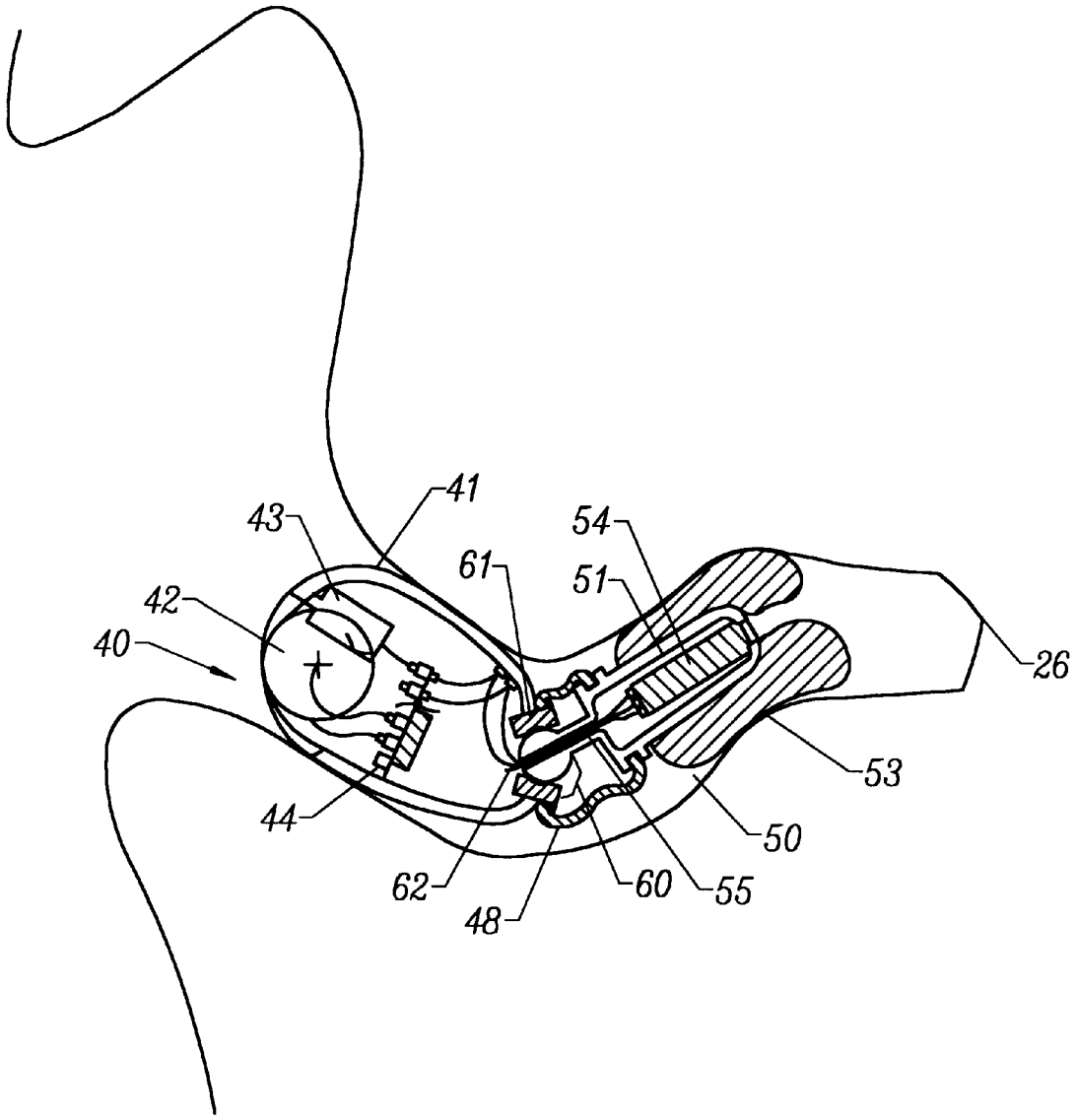
FIG. 3 shows a side view of an articulated hearing device in the transverse plane.

An example of an articulated hearing device with articulation assembly of the present invention is shown in FIG. 3. Main module 40 articulates with receiver module 50 via articulation assembly 60 which is shown in more details in the following figures. Main module 40 consists of main housing 41 which contains typical hearing aid components such as a battery 42, microphone 43, signal processing circuit 44, and other components such as adjustment controls or programming ports, not shown in the figure but well known in the field of hearing aid design. Electrical wires 52 (FIG. 4) from the main module 40 are routed through the center of articulation assembly 60 for connection to receiver terminals 77 of a receiver (speaker) 54 contained within receiver housing 51. An acoustic coupler 53 (FIG. 3) provides a conforming acoustic seal for improved comfort and feedback control as disclosed in U.S. patent application Ser. No. 08/902,401 filed on Jul. 29, 1997.

Figure 4:
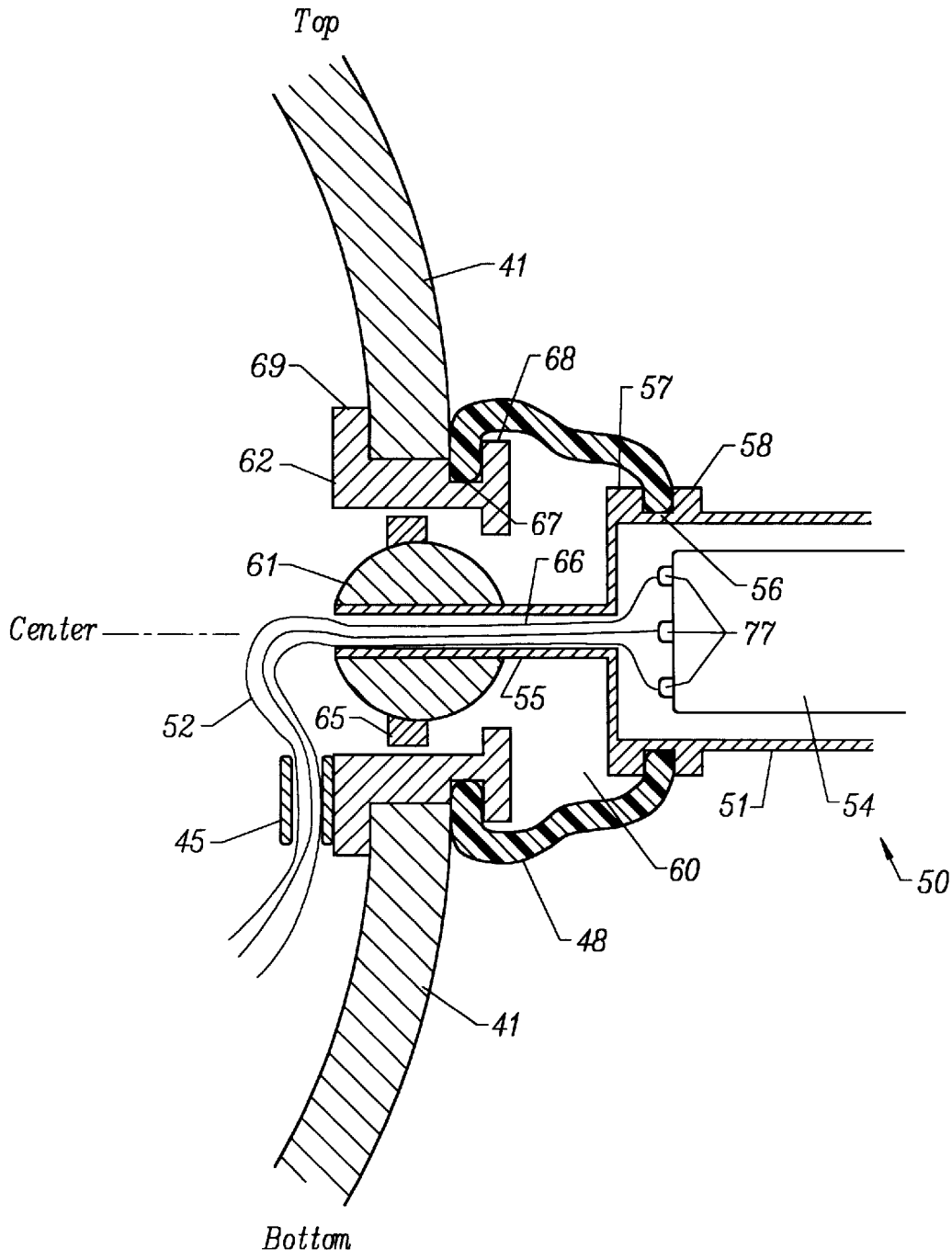
FIG. 4 shows a detailed side view of the articulation assembly in the preferred embodiment.

The articulation assembly 60, as shown in FIG. 4, is covered by a flexible boot 48 which protects the articulation assembly from environmental and physiologic residue, including cerumen (earwax). The boot 48 is fitted to the receiver housing via a boot groove 56 formed by a lateral ring 57 and a medial ring 58 (medial and lateral with respect to the tympanic membrane 26). The boot 48 is also fitted to the main module 40 via a second boot groove 67 formed by a medial ring 68 on the ball socket and the wall of the main housing 41.

Articulation assembly 60 contains a ball head 61, ball socket 62 and a connecting shaft 55 for connecting the ball head to the receiver housing 51. Ball head 61 and connecting shaft 55 contain conduit 66 for routing electrical wires 52 which electrically connect signal and power to the receiver module 50.

Figure 5:
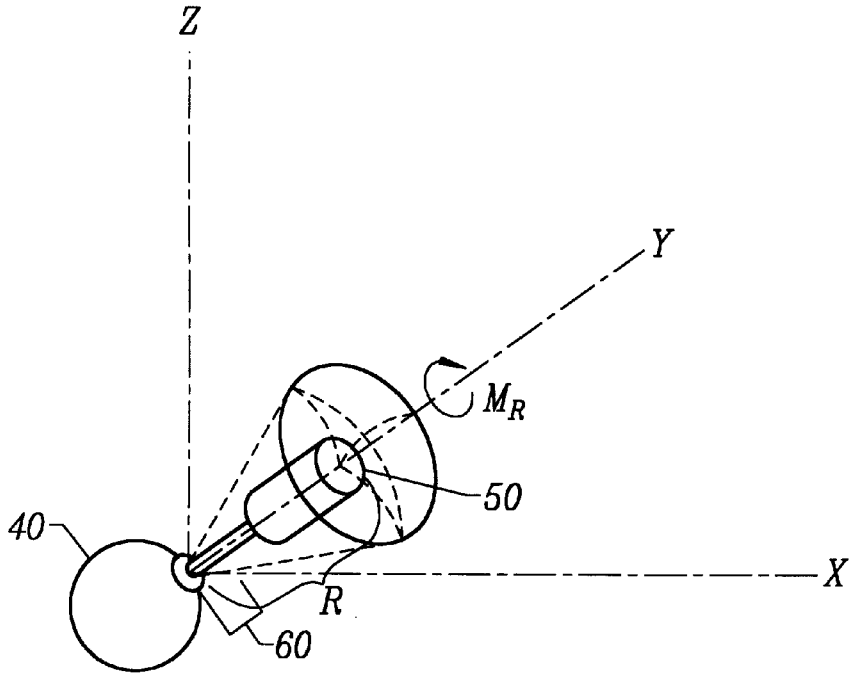
FIG. 5 shows the receiver module of an articulation assembly and the degrees of freedom it has to move relative to the main module.

The articulation assembly 60 of the present invention allows the receiver module 50 to move with respect to the main module 40 in a conic section with at least two degrees of freedom as shown in FIG. 5. This articulation allows the modules of the hearing device to adapt to the unique bends of an individual's ear canal. Movements in an XYZ sphere of radius R, bounded by a conic section as shown, are referred to here collectively as "axial" movements since they affect the axial orientation of the receiver module 50 with respect to the main module 40. Rotational movements, on the other hand, represent the rotational movement of the receiver module 50 around its own axis as shown by arrow $M_R$ in FIG. 5.

Figure 6:
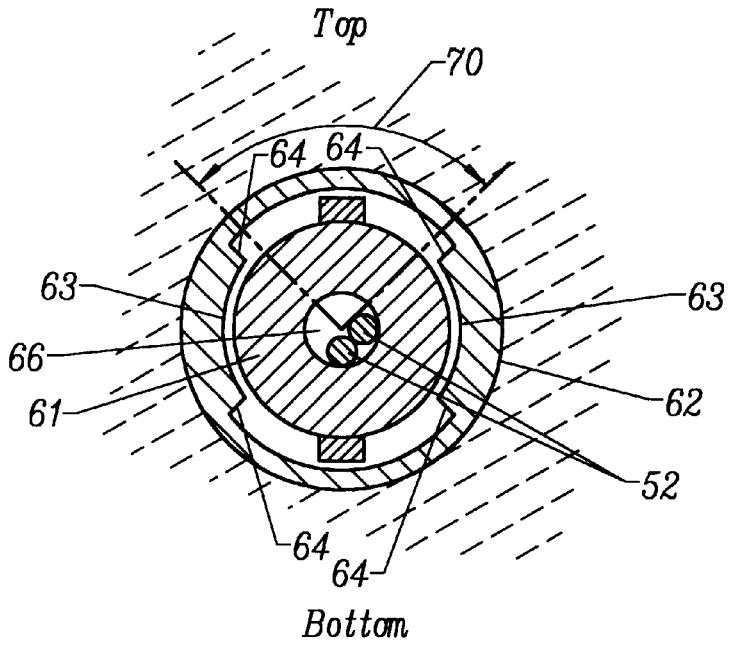
FIG. 6 is cross section of the articulation assembly showing stop pins for limiting the range of rotational movement.
Figure 7:
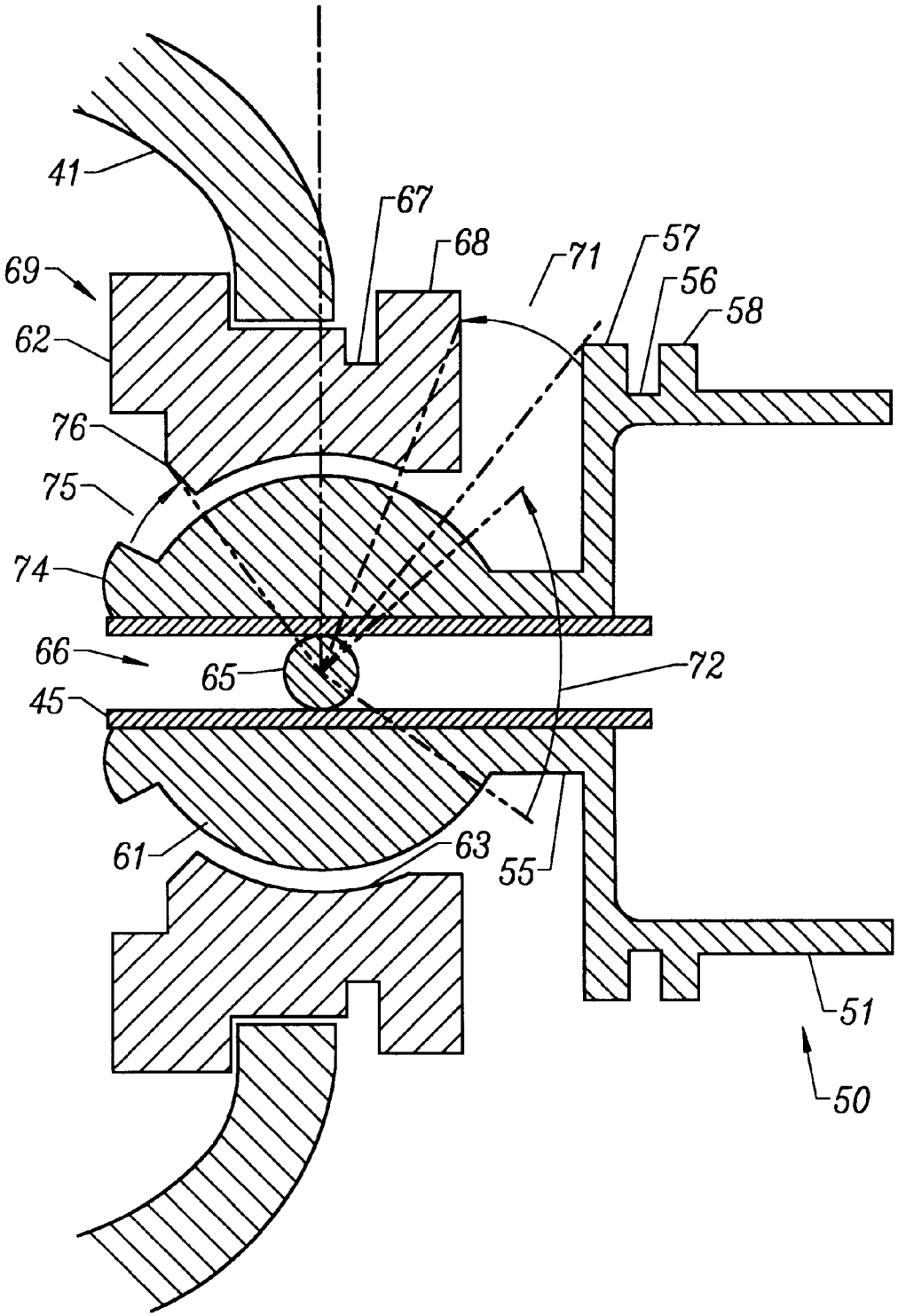
FIG. 7 shows a cross section of an articulation assembly with integrated ball, shaft and receiver housing.

Articulation assembly 60 of the preferred embodiment is shown in greater detail in FIGS. 6, and 7. Ball head 61 is partially contained in an elliptical ball socket 62 (FIG. 6) with two spherical races 63, one on each side of the minor axis of the elliptical ball socket 62. Ball head 61 has two stop pins 65, oppositely positioned in the relieved areas 64 of the ball socket 62. Relieved areas 64 allow the stop pins 65 to rotate as far as the edges of the relieved area. The shape and extent of the relieved area 64 define the range of rotational movement as shown by arrow 70 in FIG. 6.

Axial movement is also limited by features within the articulation assembly. For example, the relationship between an interiorly extended flange 74 on the ball head and the medial edge 76 of the socket 62 defines the range of axial movement as shown by arrow 75 in FIG. 7.

Axial movement may also be limited by features partially external to the articulation assembly such as the shaft 55 or boot rings 57 and 68 as shown in FIG. 6. For example, a short shaft 55 produces a range of axial movement limited by boot rings 57 and 68 as shown by arrow 71 in FIG. 7. A relatively wider range of axial movement can be achieved by a longer shaft 55 (not shown) where the range becomes limited by the shaft 55 itself and the side of the ring 68. Other features for limiting range of motion are possible once the principles disclosed above are understood by persons skilled in the art.

The articulation assembly and the associated range limiting features as shown in the figures are highly compact and can be placed essentially flush with wall 41 of main housing 40 instead of protruding within.

Electrical wires 52 routed within conduit 66 experience movement while the hearing device is flexing. This movement occurs during device insertion and removal from ear canal or during jaw motion while the device is in the canal. Strain relief for the moving portion of the electrical wiring is required in order to protect the integrity of electrical wires during flexion. Deterioration of the wiring might be manifested by audible noise due to an intermittent connection, or loss of audible signal entirely due to wire breakage or due to a short circuit when the insulation of the wires deteriorates. A wire strain relief means 45 encapsulating the electrical wires 52 can be placed on the interior of the main module 40, near or at the ball socket 62 as shown in FIG. 4. The strain relief means 45 can also be inserted within the conduit 66 as shown in FIG. 6. Wire strain relief can be achieved by soft tubing, as shown in the figures, or by injecting a non-hardening gel or gel-like material (not shown) within the conduit 66 or outside the conduit around the moving portion of electrical wiring 52.

The ball head 61 may be a separate part but attached to the shaft 55 as shown in FIG. 4. Alternatively, the ball head 61 may be an integral part of the shaft 55 and the receiver housing 51 as shown in FIG. 7. A singular molded design is generally preferred because it leads to a more durable design and allows a more cost-effective manufacturing process.

Figure 8:
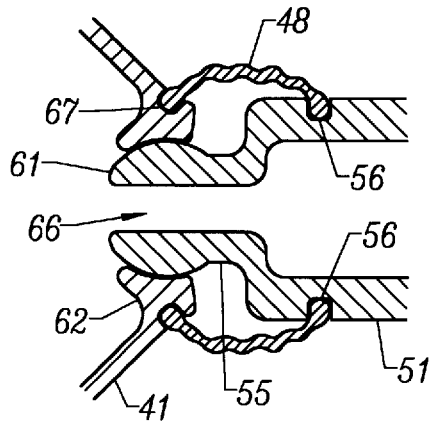
FIG. 8 shows another embodiment of the articulation joint with ball socket integrated within main housing of hearing device.

Similarly, the ball socket 62 may be integrated within main housing 41 as shown in FIG. 8. Boot grooves 67 and 56 are also molded in the main housing 41 and receiver housing 51 as shown in FIG. 8.

The boot 48 is preferably made of a flexible viscoelastic material in order to isolate the vibrations of the receiver module 50 from the main module 40, thus minimizing occurrence of feedback. A bellows-like boot design 48 is shown in FIG. 8 to further facilitate axial movement of the receiver module.

The flexible boot is preferably elastomeric to provide a minimal bias force to orient the receiver module 50 with respect to the main module 40 prior to device insertion into the ear canal. This bias force provides a proper and consistent orientation of the receiver module to facilitate insertion, particularly for persons of limited manual dexterity. However, the boot's elastomeric force is relatively weak thus allowing the articulated modules to freely assume any position according to the shape and contours within an individual's ear canal.

The flexible boot can be color coded to differentiate right and left devices for the user. This is desirable since miniature devices often look similar leading the user to incorrectly insert a right device in left ear for example. The hearing aid industry had long adapted Red for Right and Blue for Left. It is therefore desirable to provide Red/Blue colored boot for Right/Left ears, respectively.

Figure 9:
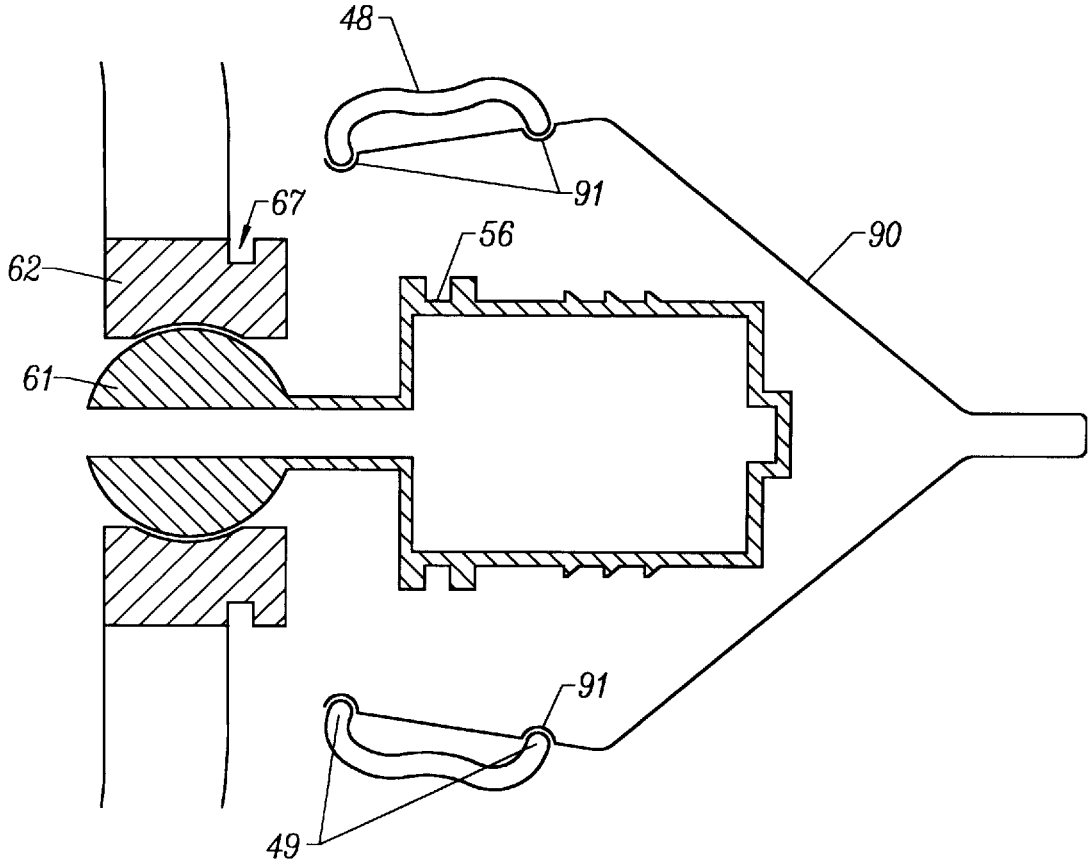
FIG. 9 shows a ball joint assembly coupled to main housing via a vibration damper ring.

To facilitate boot placement on the ball articulation assembly and the receiver module, a boot placement tool was devised. FIG. 9 shows a placement forceps 90 with grooves 91 for holding and expanding the boot 48 prior to releasing it for placement within receiver boot groove 56 and main module boot groove 67.

Figure 10:
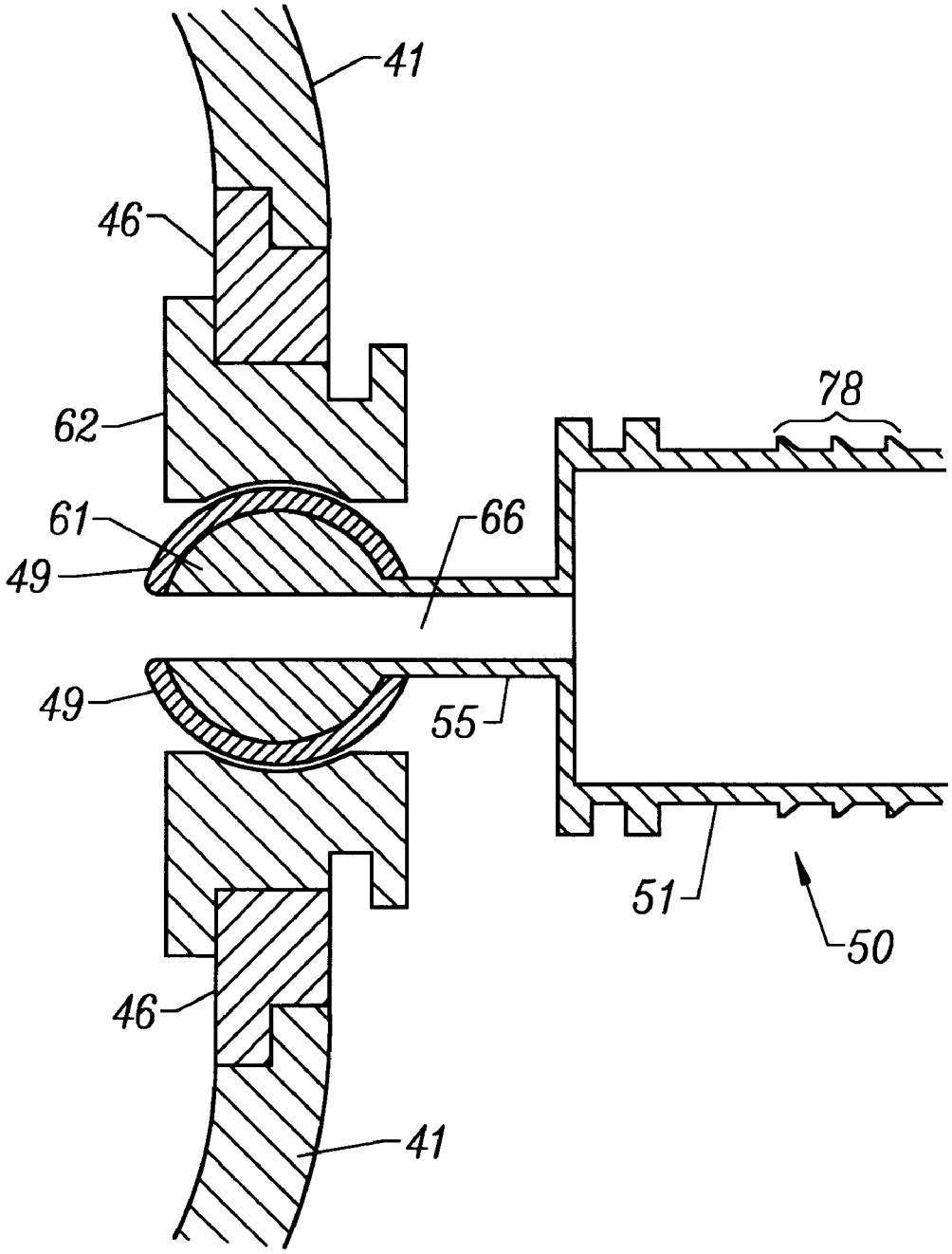
FIG. 10 shows another embodiment of the articulation joint with an interiorly extended shaft and stop pin.

To further increase the mechano-acoustic isolation of the main module 40 from the receiver module 50, a vibration damper ring 46 is provided between the ball socket 62 and the main housing wall 41 as shown in FIG. 10. The vibration damper ring 46 is preferably made of a durable viscoelastic material such as certain types of rubber. A lubricant 49 coating the ball head 61 further provides mechano-acoustic isolation as well as minimizing friction between the ball head 61 and ball socket 62. The lubricant material may be petroleum-based such as Chevron SRI-2 or a fluorinated grease such as Krytox 240-AC.

Figure 11:
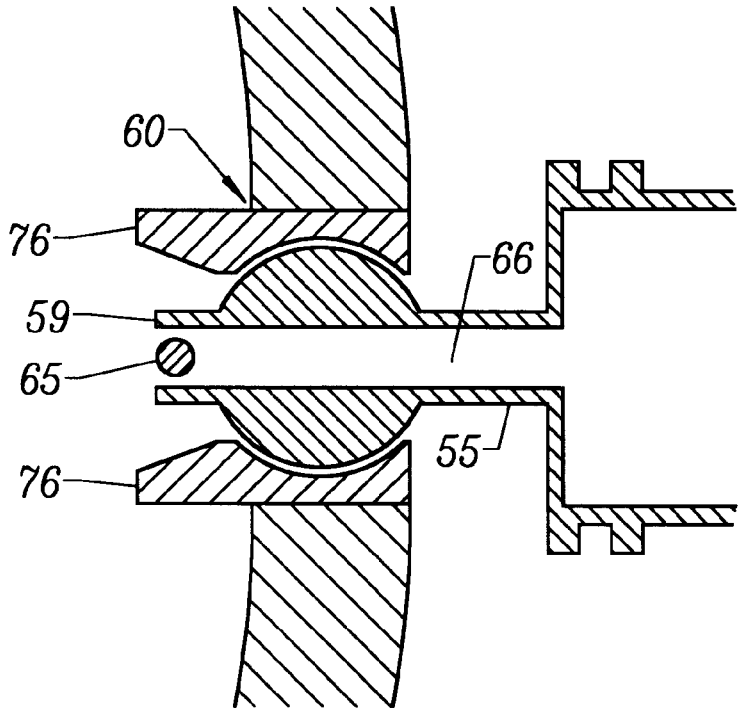
FIG. 11 shows an orthogonal view of the interiorly extended shaft and stop pin.
Figure 12:
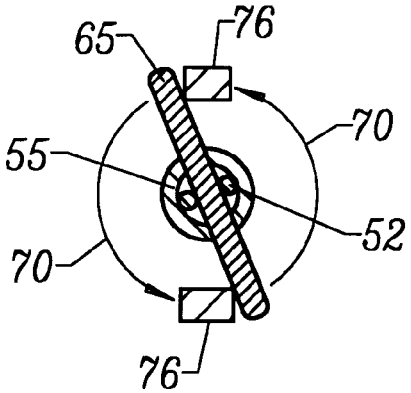
FIG. 12 shows an embodiment of articulation assembly with a receiver partially inserted in ball head.

Another embodiment of the articulation assembly of the present invention with range of motion limiting features partially contained within articulation assembly is shown in FIGS. 11 and 12. A stop pin column 65 is inserted in shaft protrusion 59 extending inwardly toward the center of the main module 40. Similarly, the ball socket has inwardly extended edge 76 to limit the motion of stop pin column 65. The rotational articulation range is limited by the relationship of the stop pin 65 and extended edge 76 as shown in FIGS. 11 and 12.

Figure 13:
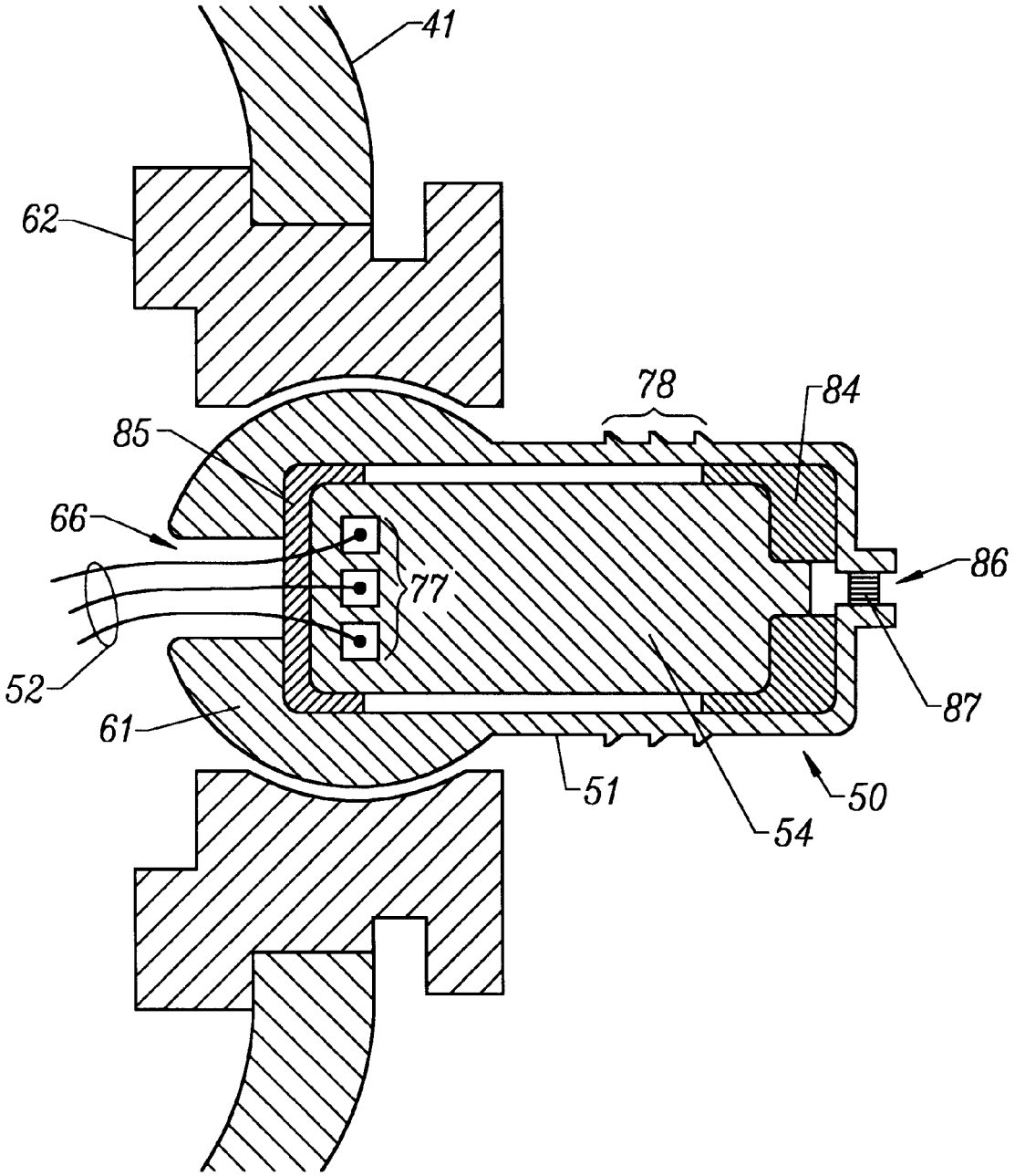
FIG. 13 shows a tool for placing a boot on the articulation assembly.

In another embodiment of the present invention shown in FIG. 13, the ball head 61 is continuous with the receiver housing 51, and the receiver 54 is partially housed within the ball head 61. Medial and lateral receiver dampers, 84 and 85 respectively, mechano-acoustically isolate the receiver 54 from the receiver housing 51 and the ball head 61. A debris guard 87, near the receiver sound port 86, protects the receiver 54 from environmental and physiologic residue, including cerumen (earwax). A miniature elongated receiver such as model SD series manufactured by Knowles Electronics, Inc. of Itasca, Ill. is particularly suited for insertion into a miniature ball head of the articulation assembly of the present invention. Receiver housing threads 78 secure the attachment of acoustic coupler 53.

Figure 14:
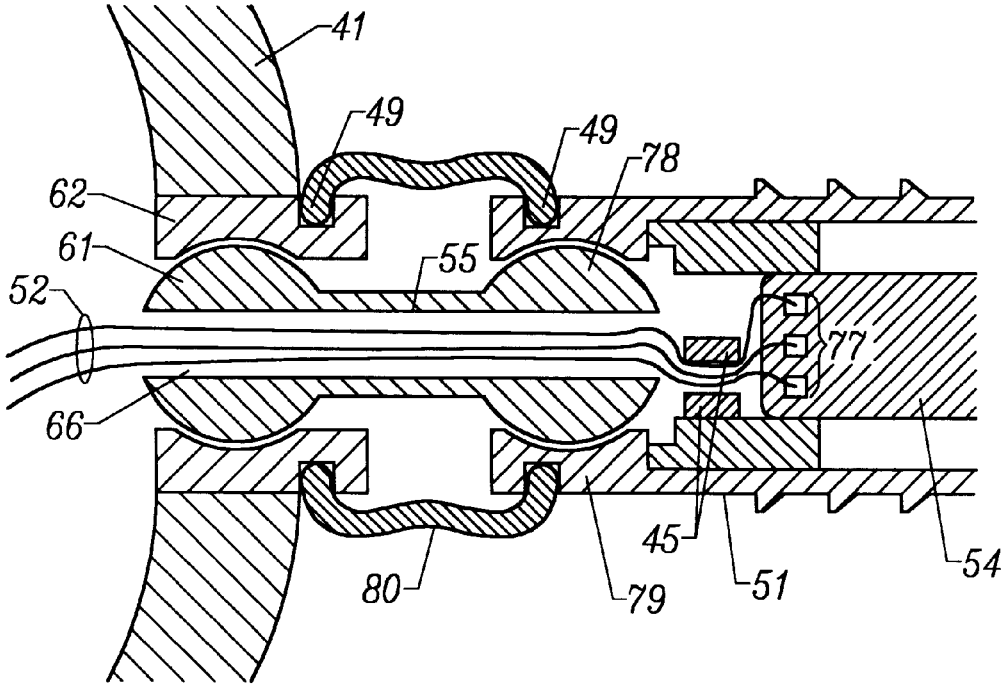
FIG. 14 shows an intracanal hearing device with two articulation joints and a connecting shaft.

Another embodiment of the present invention provides two articulation joints as shown in FIG. 14. The first articulation assembly is embedded within the wall of the main housing 41 as discussed above. A second articulation assembly is at the lateral end of the receiver module 50 with a second ball head 78 and a second ball socket 79. A shaft 55 connects ball heads 61 and 78. The advantages of this dual articulation system include increased depth of receiver insertion into the ear canal and increased flexibility within. Each articulation includes stops (not shown) as discussed above for limiting the range of articulation and preserving the electromechanical integrity of the joints and wiring within.

Similarly, strain relief means 45 for protecting the electrical wiring 52 at the second articulation assembly is required, particularly near the receiver terminals 77 as shown in FIG. 14.

Figure 15:
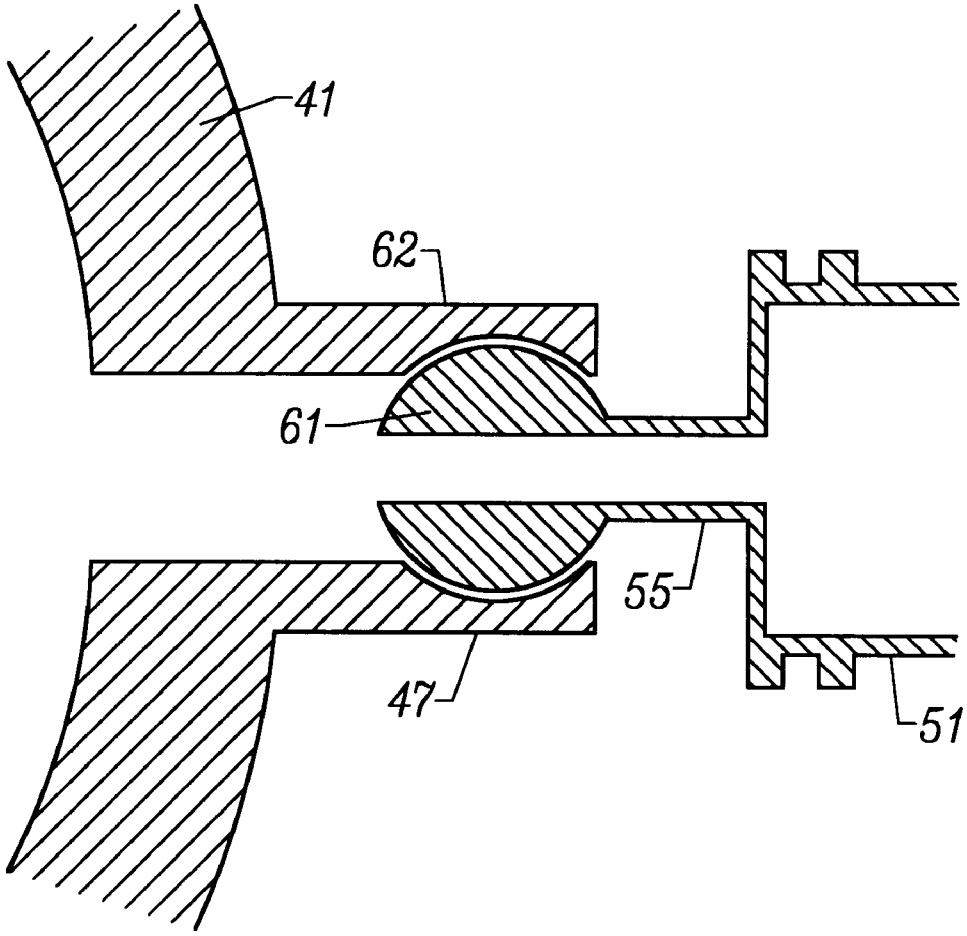
FIG. 15 shows an articulation assembly connected to an extended main housing shaft.

Another embodiment of the present invention is a hearing device with a medially extended main housing shaft 47 as shown in FIG. 15. The main housing shaft 47 comprises a ball socket 62 at its medial end which encapsulates the ball head 61 connected to a receiver housing 51 via a shaft 55. Similarly, range of motion stops (not shown) are contained within the ball joint assembly as disclosed above for limiting one or more degrees of motion.

This invention is mainly concerned with providing an articulation assembly for use with any modular intracanal hearing device. The modules of a hearing device may be configured entirely differently from the examples described above. For example, a receiver module may contain a battery in addition to a receiver. The main module may include or exclude other components as necessary for the operation of the hearing device. The configuration of the components within the articulated modules is not particularly relevant to the present invention which primarily deals with providing a highly efficient articulation assembly for use within the ear canal.

Figure 16:
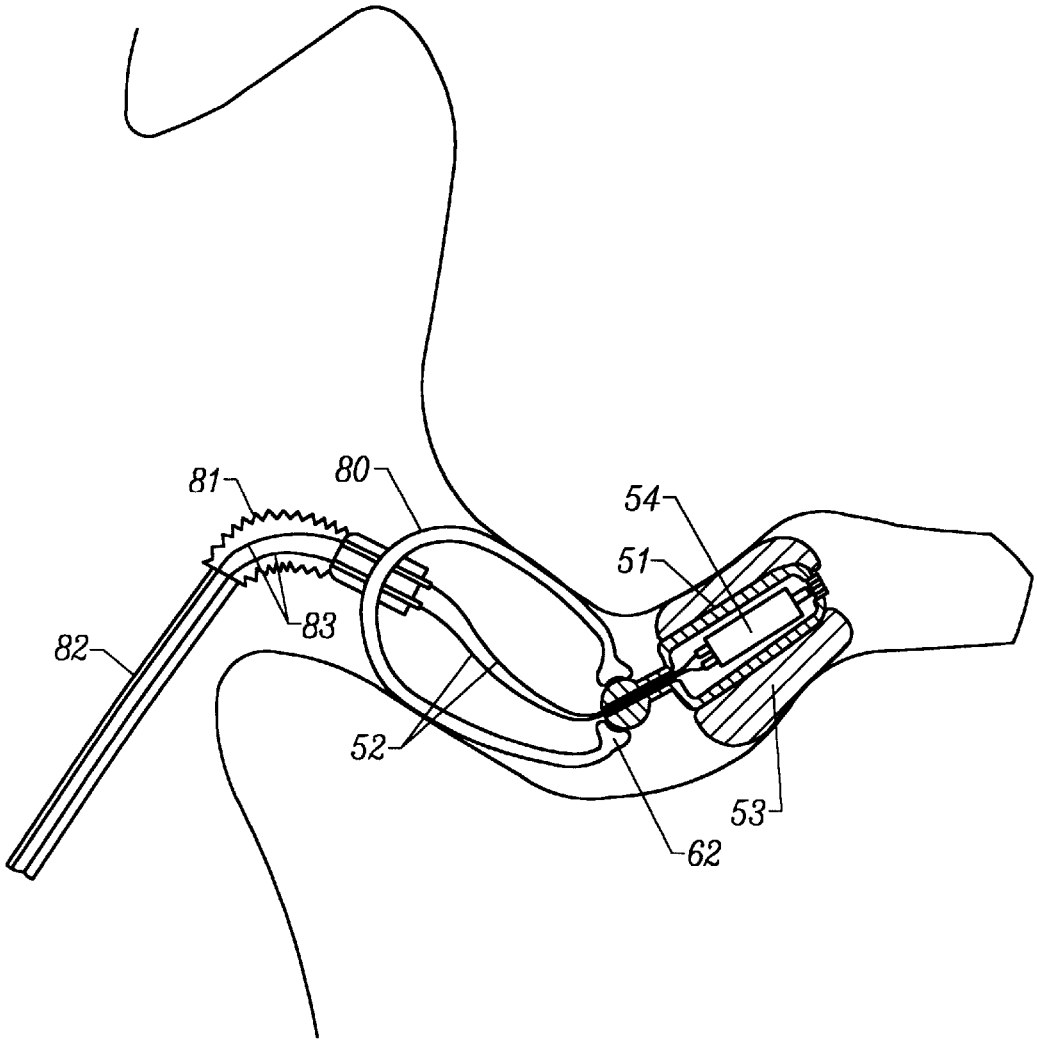
FIG. 16 shows an articulated intracanal earpiece.

The articulation assembly of the present invention is particularly suited for hearing aids. However, its application is also well-suited for other intracanal device where it is desired to deliver sounds deeply within the ear canal. FIG. 16 shows an articulated earpiece 80 as a part of an audio system external to the ear canal but coupled, either electrically via signal cable 82 or by other means (not shown). A handle 81 facilitates insertion and removal as well as providing strain relief for the cable wires 83 within the signal cable 82. Other means to couple audio signals into the earpiece include a wireless link such as radio frequency (RF) or infrared (IR).

Figure 17:
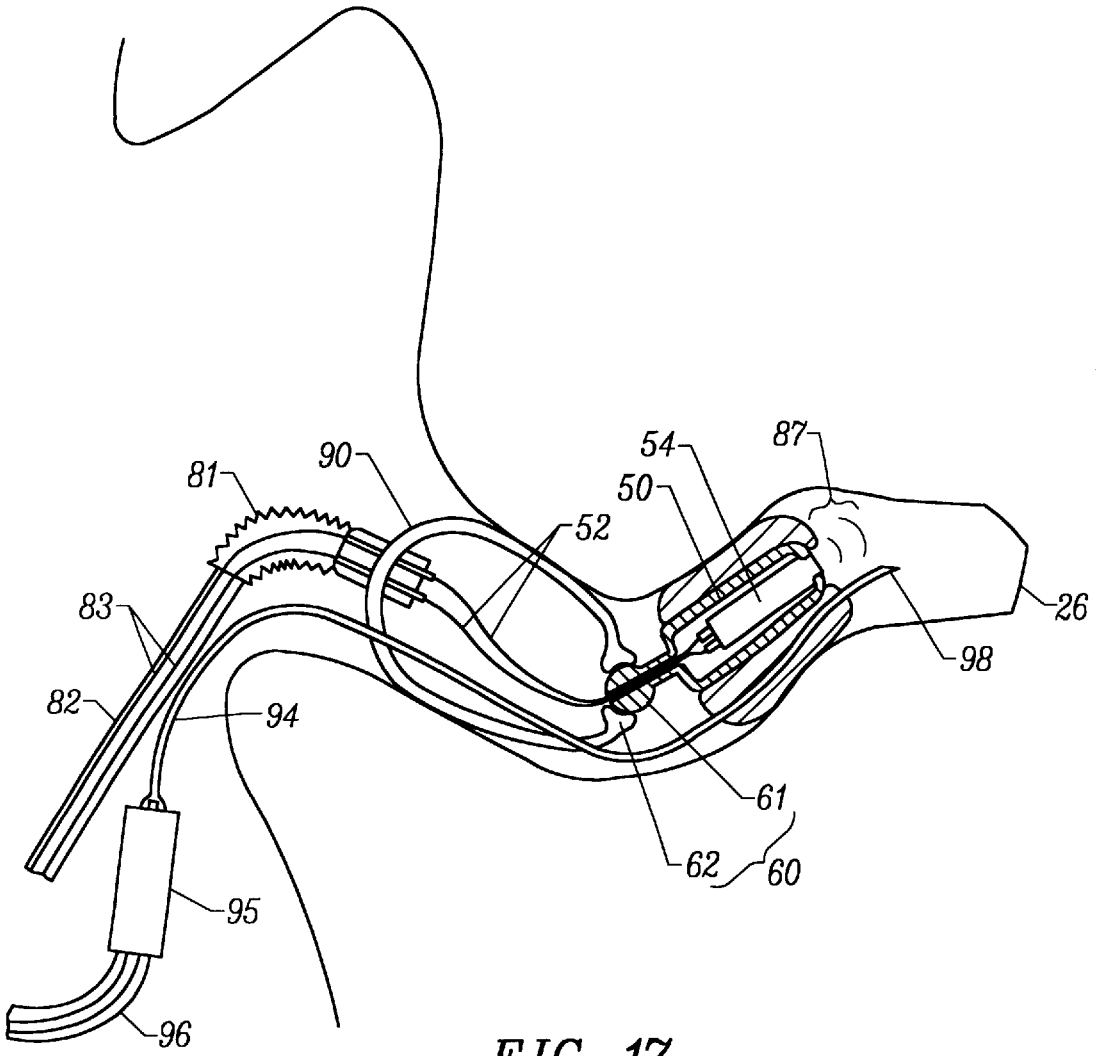
FIG. 17 shows an intracanal transducer for hearing evaluation and hearing aid simulation.

Another application of the invented articulation assembly is for use with intracanal transducers during hearing evaluation or hearing aid simulation as shown in FIG. 17. During hearing evaluation, pure tones or any other audiologically significant signals, such as speech, music or noise, are produced to assess the hearing ability or profile of an individual. In a related application, acoustic signals representative of those produced by a hearing aid can be produced by an intracanal transducer to simulate the performance of a prescribed hearing aid. In these hearing applications, an intracanal transducer 90 is connected via a signal cable 82 to an audiometric module or an appropriate signal generating device external to the ear canal (not shown). These externally produced electrical signals are conducted via electrical wiring 52 within the intracanal transducer 90 and are then delivered via articulation assembly 60 to a receiver 54 within a receiver module 50. The receiver 54 produces acoustic signals 87 (near the tympanic membrane 26) that are representative of audiometric signals for hearing evaluation, or representative of a simulated hearing aid. The acoustic signals 87 are then measured simultaneously by an intracanal probe tube 94 with its tip 98 positioned within close proximity to the tympanic membrane. The intracanal probe tube 94 is connected to a microphone amplifier assembly 95 which converts the measured acoustic signals 87 to electrical signals via a measuring signal cable 96. The measured electrical signal is then connected to an audiometric module or to the appropriate measuring device (not shown).

The application of articulation assembly of the present invention is not limited to hearing aids, audio and communication earpieces, hearing evaluation or hearing aid simulation applications as mentioned in the above examples. Other applications for delivering acoustic signals deeply and comfortably within the ear canal should become obvious once the principles of, the present invention are disclosed and understood.

Although the invention is described herein with reference to the preferred embodiment, one skilled in the art will readily appreciate that other applications may be substituted for those set forth herein without departing from the spirit and scope of the present invention. Accordingly, the invention should only be limited by the claims included below.

What is claimed is:

1. In a hearing device comprising at least two modules, an articulation assembly for separating said modules while allowing relative movement of said modules within an ear canal, said articulation assembly comprising:

a spherical ball associated with a first of said modules;

a ball socket associated with a second of said modules for receiving said spherical ball and for permitting movement of said spherical ball therein, wherein said ball socket has an elliptical shape and includes a spherical race, and wherein said elliptical ball socket includes one or more relieved areas along an axis thereof for limiting rotation; and means entirely contained within said articulation assembly for restricting axial rotation of said modules relative to each other.

2. The articulation assembly of claim 1, wherein said articulation assembly is substantially contained along a wall of one of said modules and arranged for connection to another of said modules.

3. The articulation assembly of claim 1, further comprising:

a conduit for routing electrical wiring between said modules.

4. The articulation assembly of claim 3, further comprising:

a strain relief for said electrical wiring located proximate to or within said conduit.

5. The articulation assembly of claim 4, said strain relief comprising at least one of a soft tubing and a non-hardening gel or gel-like material.

6. The articulation assembly of claim 1, wherein said ball socket is integrated with a housing of one of said modules.

7. The articulation assembly of claim 6, wherein said integrated ball socket and module housing are molded.

8. The articulation assembly of claim 1, wherein said spherical ball further comprises a shaft projecting therefrom for coupling said spherical ball to one of said modules.

9. The articulation assembly of claim 8, wherein said spherical ball and said shaft are integrated.

10. The articulation assembly of claim 9, wherein said spherical ball and said shaft are molded.

11. The articulation assembly of claim 9, wherein said spherical ball, said shaft, and a housing of one of said modules are integrated.

12. The articulation assembly of claim 11, wherein said spherical ball, said shaft, and said housing are molded.

13. The articulation assembly of claim 1, further comprising:

a lubricant between said spherical ball and said ball socket.

14. The articulation assembly of claim 13, wherein said lubricant has viscoelastic properties for any of mechanical isolation and acoustic isolation.

15. The articulation assembly of claim 1, wherein said ball socket is connected to a rigid wall of one of said modules via a vibration dampening ring provided between said ball socket and said wall of said module.

16. The articulation assembly of claim 15, wherein said vibration damper material has viscoelastic properties.

17. The articulation assembly of claim 1, wherein at least a single degree of freedom of movement is at least partially limited by said ball socket.

18. The articulation assembly of claim 10, wherein at least a single degree of freedom of movement is at least partially limited by the length of said shaft.

19. The articulation assembly of claim 1, wherein at least a single degree of freedom of movement is at least partially limited by a housing of one of said modules.

20. The articulation assembly of claim 1, wherein one or more of said articulation assemblies are provided for use with a canal hearing aid.

21. The articulation assembly of claim 1, wherein at least one of said modules contains a receiver and is positioned proximal to a user's ear canal.

22. The articulation assembly of claim 1, wherein one or more of said articulation assemblies are provided for use with an intracanal earpiece in conjunction with an external audio system connected thereto via either of a cable or wireless link.

23. The articulation assembly of claim 1, wherein one or more of said articulation assemblies are provided for use with an intracanal transducer comprising a receiver module for delivering acoustic stimuli within a user's ear canal for hearing evaluation and hearing aid simulation.

24. The articulation assembly of claim 1, wherein one or more of said articulation assemblies are provided for use with an intracanal transducer having means for performing intracanal acoustic measurements.

25. The articulation assembly of claim 24, wherein said means for performing acoustic measurements comprise a probe tube.

26. The articulation assembly of claim 1, wherein one or more of said articulation assemblies are provided for use with an intracanal transducer having means for simultaneously delivering acoustic stimuli within a user's ear canal and means for performing intracanal acoustic measurements.

27. The articulation assembly of claim 1, further comprising:

a flexible covering boot for protecting said articulation assembly.

28. The articulation assembly of claim 27, said covering boot is adapted to be fitted to said articulation assembly via a boot groove.

29. The articulation assembly of claim 27, wherein said covering boot is replaceable.

30. The articulation assembly of claim 27, wherein said covering boot has elastomeric properties for biasing the orientation of said modules relative to each other.

31. The articulation assembly of claim 27, further comprising:

a tool for replacing said covering boot by expanding said covering boot for attachment around said articulation assembly.

32. The articulation assembly of claim 27, wherein said covering boot is formed of a viscoelastic material that provides mechanical and acoustic isolation between said modules.

33. The articulation assembly of claim 1, said means for restricting movement comprising one or more stop pin or stop columns on said spherical ball for limiting at least one degree of freedom of movement.

34. A hearing device comprising at least two modules, said hearing device having at least one articulation assembly for separating said modules and for allowing said modules to move relative to each other with an ear canal, said articulation assembly comprising:

a rigid spherical ball associated with a first of said modules;

a ball socket associated with a second of said modules for receiving said spherical ball, wherein said ball socket has an elliptical shape and includes an elliptical race and wherein said elliptical ball socket includes one or more relieved areas along an axis thereof for limiting rotation; and means entirely contained within said articulation assembly for restricting axial rotation of said modules relative to each other.

35. The hearing device of claim 34, wherein said articulation assembly is substantially contained along a wall of one of said modules and arranged for connection to another of said modules.

36. The hearing device of claim 34, said articulation assembly further comprising:

a conduit for routing electrical wiring between said modules.

37. The hearing device of claim 36, said articulation assembly further comprising:

a strain relief for said electrical wiring located proximate to or within said conduit.

38. The hearing device of claim 37, said strain relief comprising at least one of a soft tubing and a non-hardening gel or gel-like material.

39. The hearing device of claim 34, wherein said ball socket is integrated with a housing of one of said modules.

40. The hearing device of claim 39, wherein said integrated ball socket and module housing are molded.

41. The hearing device of claim 34, wherein said spherical ball further comprises a shaft projecting therefrom for coupling said spherical ball to one of said modules.

42. The hearing device of claim 41, wherein said spherical ball and said shaft are integrated.

43. The hearing device of claim 42, wherein said spherical ball and said shaft are molded.

44. The hearing device of claim 42, wherein said spherical ball, said shaft, and a housing of one of said modules are integrated.

45. The hearing device of claim 44, wherein said spherical ball, said shaft, and a housing of one of said modules are molded.

46. The hearing device of claim 34, said articulation assembly further comprising:

a lubricant between said spherical ball and said ball socket.

47. The hearing device of claim 46, wherein said lubricant has viscoelastic properties for any of mechanical isolation and acoustic isolation.

48. The hearing device of claim 34, wherein said ball socket is connected to a rigid wall of one of said modules via a vibration dampening ring provided between said ball socket and said wall of said module.

49. The hearing device of claim 48, wherein said vibration damper material has viscoelastic properties.

50. The hearing device of claim 34, wherein at least a single degree of freedom of movement is at least partially limited by said ball socket.

51. The hearing device of claim 41, wherein at least a single degree of freedom of movement is at least partially limited by the length of said shaft.

52. The hearing device of claim 34, wherein at least a single degree of freedom of movement is at least partially limited by a housing of one of said modules.

53. The hearing device of claim 34, wherein one or more of said articulation assemblies are provided for use with a canal hearing aid.

54. The hearing device of claim 34, wherein at least one of said modules contains a receiver and is positioned proximal to a user's ear canal.

55. The hearing device of claim 34, wherein one or more of said articulation assemblies are provided for use with an intracanal earpiece in conjunction with an external audio system connected thereto via either of a cable or wireless link.

56. The hearing device of claim 34, wherein one or more of said articulation assemblies are provided for use with an intracanal transducer comprising a receiver module for delivering acoustic stimuli within a user's ear canal for hearing evaluation and hearing aid simulation.

57. The hearing device of claim 34, wherein one or more of said articulation assemblies are provided for use with an intracanal transducer having means for performing intracanal acoustic measurements.

58. The hearing device of claim 37, wherein said means for performing acoustic measurements comprise a probe tube.

59. The hearing device of claim 34, wherein one or more of said articulation assemblies are provided for use with an intracanal transducer having means for simultaneously delivering acoustic stimuli within a user's ear canal and means for performing intracanal acoustic measurements.

60. The hearing device of claim 34, further comprising:

a flexible covering boot for protecting said articulation assembly.

61. The hearing device of claim 60, wherein said covering boot adapted to be fitted to said articulation assembly via at least one boot groove.

62. The hearing device of claim 60, wherein said covering boot is replaceable.

63. The hearing device of claim 60, wherein said covering boot has elastomeric properties for biasing the orientation of said modules relative to each other.

64. The hearing device of claim 60, further comprising:

a tool for replacing said covering boot by expanding said covering boot for attachment around said articulation assembly.

65. The hearing device of claim 60, wherein said covering boot is formed of a viscoelastic material that provides mechanical and acoustic isolation between said modules.

66. The hearing device of claim 34, said means for restricting movement comprising one or more stop pins or stop columns on said spherical ball for limiting at least one degree of freedom of movement.

* * * * *